United States Patent [19]

Thrower et al.

[11] Patent Number: 4,899,992

[45] Date of Patent: Feb. 13, 1990

[54] DEVICES AND APPARATUS FOR INJECTING GAS INTO HIGH TEMPERATURE LIQUIDS, E.G. MOLTEN METALS

[75] Inventors: Anthony Thrower; John R. Gelsthorpe, both of Sheffield, England

[73] Assignee: Injectall Limited, Sheffield, England

[21] Appl. No.: 246,850

[22] PCT Filed: Feb. 15, 1988

[86] PCT No.: PCT/GB88/00091

§ 371 Date: Mar. 14, 1989

§ 102(e) Date: Mar. 14, 1989

[87] PCT Pub. No.: WO88/06191

PCT Pub. Date: Aug. 25, 1988

[30] Foreign Application Priority Data

Feb. 18, 1987 [GB] United Kingdom ..... 8703717

[51] Int. Cl.[4] ..... C22C 5/48; B22D 37/00

[52] U.S. Cl. ..... 266/44; 222/590; 222/600; 266/220; 266/236; 266/270

[58] Field of Search ..... 266/44, 47, 220, 265, 266/270, 236; 222/600, 590

[56] References Cited

U.S. PATENT DOCUMENTS

| | | | |
|---|---|---|---|
| 3,373,986 | 3/1968 | Spire | 266/220 |
| 3,971,548 | 7/1976 | Folgero et al. | 266/218 |
| 4,575,393 | 3/1986 | Bates et al. | 75/58 |
| 4,742,995 | 5/1988 | Bates | 266/270 |

FOREIGN PATENT DOCUMENTS

| | | | |
|---|---|---|---|
| 186852 | 7/1986 | European Pat. Off. . | |
| 3115108 | 10/1982 | Fed. Rep. of Germany . | |
| 3240097 | 5/1984 | Fed. Rep. of Germany . | |
| 3523171 | 10/1986 | Fed. Rep. of Germany . | |
| 2451945 | 10/1980 | France . | |
| 41-18201 | 10/1966 | Japan | 266/220 |
| 59-38321 | 3/1984 | Japan | 266/220 |
| 60-86206 | 5/1985 | Japan . | |
| 1452910 | 10/1976 | United Kingdom | 266/220 |
| 2094954 | 2/1982 | United Kingdom . | |
| 2150868 | 7/1985 | United Kingdom | 266/220 |
| 8600695 | 1/1986 | World Int. Prop. O. . | |

OTHER PUBLICATIONS

Radex Rundschau, Heft 3, 1983, pp. 179 to 209.

*Primary Examiner*—Robert McDowell
*Attorney, Agent, or Firm*—Buchanan, Ingersoll

[57] ABSTRACT

For injecting gas into a liquid, more particularly a molten metal, a nozzle body (24) is installed in the wall of a liquid containment vessel, the body (24) having a nozzle passage (25) therethrough. Liquid and gas tightly fitted in a downstream end of the passage is solid, gas porous plug (18) having capillary gas passage (20). Upstream of the plug (18) the passage has a gas-porous and liquid-impermeable cartridge (10) closely fitted therein which prevents liquid which may conceivably pass through the plug (18) from leaking out of the passage (25). The cartridge (10) has a gas impermeable metal sleeve (11) containing a particulate material (16) such as sand which is retained in the sleeve (11) by wads (14, 15) of fibrous material at the ends of the sleeve.

31 Claims, 4 Drawing Sheets

Figure 1:
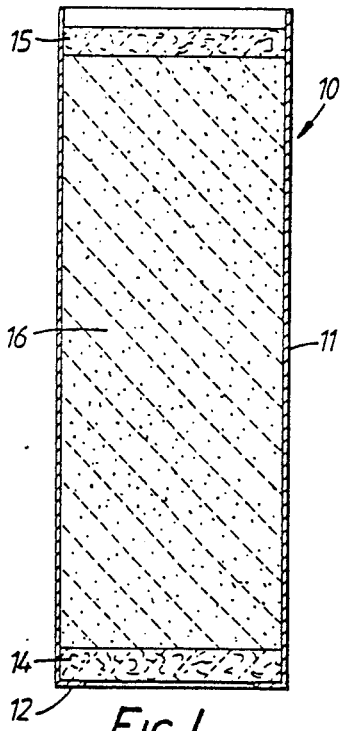

DEVICES AND APPARATUS FOR INJECTING GAS INTO HIGH TEMPERATURE LIQUIDS, E.G. MOLTEN METALS

The invention relates to devices and apparatus for injecting gas into high temperature liquids, e.g. molten metals.

It may often be necessary to introduce gas into molten metal in a container or vessel. Gas is injected, for instance into the bottom area of a vessel for diverse purposes, including rinsing; clearing the relatively cool bottom area of solidification products, to help remove them from the vicinity of the vessel bottom outlet where the vessel has such an outlet; equalising the temperature throughout the melt; and stirring to help disperse alloying additions uniformly in the melt. Usually an inert gas is used, e.g. argon. Reactive gases are sometimes substituted if the melt needs some particular chemical treatment such as deoxidising.

Previous gas injection proposals have included the provision of a solid porous plug or brick in the refractory lining of the vessel, and of solid porous plugs in sliding gate teeming valves. Installations featuring porous plugs have the virtue of simplicity, but are potentially hazardous, inter alia because they may crack due to thermal shock when molten metal is introduced into the vessel. Failure of the plug can obviously have extremely dangerous consequences. Sliding gate valves adapted for gas injection are safer, but unless overly complicated they are not able to offer the possibility of gas injection simultaneously with teeming.

The present invention aims to overcome drawbacks associated with prior gas injection systems, and to provide safer and more cost effective equipment for use in gas injection.

According to one aspect of the present invention, there is provided an injection cartridge, for use in injecting gas through the wall of a vessel into a high temperature liquid contained therein, the cartridge comprising an open-ended gas-impermeable sleeve blocked adjacent each of its opposite ends by a wad of fibrous refractory material and containing a filling of particulate refractory matter, the cartridge being permeable to gas flow from one end to the other and impermeable to liquid flow therethrough. Such cartridges are well able to cope with thermal shock and, in conjunction with further gas injection components, provide valuable measures of added safety to gas injection operations as will become apparent as the description proceeds.

Gas injection apparatus according to the invention can comprise a cartridge as defined in the preceding paragraph, and a refractory gas-discharge block arranged in tandem therewith, the discharge block having one end interfitting with one end of the cartridge and being porcus or foraminous to allow gas but not liquid to traverse the block.

The gas discharge block can be made of porous refractory; alternatively, it can be made of substantially gas-impermeable refractory material pierced by one or more capillary passageways.

According to another aspect of the invention, there is provided a gas injection nozzle, for installation in the wall of a vessel and for use in injecting gas into a high temperature liquid, comprising a refractory nozzle body having a passage therein and a gas porous or foraminous end portion closing the passage at a discharge end of the body, and closely fitted in the passage is a porous gas injection cartridge comprising an open-ended, gas-impermeable sleeve having upstream and downstream ends, closed adjacent each end by a compressible wad of fibrous refractory material and containing a filling of particulate refractory matter, the cartridge being permeable to gas flow from the upstream to the downstream end and impermeable to liquid flow therethrough. In the event of liquid, such as molten metal, traversing the passage-closing end portion e.g. after a failure of the latter, the cartridge can prevent a serious leakage of said liquid from the passage. Gas inlet means for conveying gas from a supply to an upstream end of the cartridge can be arranged to urge the cartridge into sealing contact with the said end portion; the cartridge and end portion can be designed to interfit one with the other.

Further according to the present invention, there is provided metal pouring apparatus comprising a container vessel for molten metal, an opening in or adjacent the bottom of the vessel and associated means operable to control teeming of molten metal through the opening, and means for injecting gas into molten metal in the vessel, the injecting means including a nozzle installed in a wall of the vessel in the vicinity of an seperate from the said opening and the teeming control means, and ducting exteriorly of the vessel for conveying gas to a passage through the nozzle, the ducting including two abutting orificed refractory bodies, one of the refractory bodies being movable relative to the other to place the orifices out of registry thereby to close the ducting and prevent any molten metal entering the nozzle passage from escaping from the vessel via the nozzle and ducting, and inside the passage there is melt-tightly fitted an injection cartridge comprising an open-ended, gas-impermeable sleeve closed adjacent each of its opposite ends by a compressible wad of fibrous refractory material and containing a filling of particulate refractory matter, the cartridge being permeable to flow of gas towards the vessel interior and impermeable to flow of molten metal therethrough.

The invention also provides a method of metal pouring employing apparatus as defined in the last preceding paragraph, wherein gas is injected into the molten metal in the container through the gas injection means simultaneously with teeming the metal from the container via the teeming control means.

The gas injection means in this apparatus can be located adjacent the vessel bottom in its side wall, but like the teeming control means will usually be located in the vessel bottom.

Inspection of the cartridge for evidence of metal leakage involves straightforward visual examination of the underside thereof, coupled possibly with inspection of the orificed body further therefrom of both bodies. Traces of frozen metal on these members indicate the apparatus is in need of servicing and at this stage the refractory bodies will be manipulated to a duct-closing setting until the vessel has been emptied.

Preferably the means to control teeming is a sliding gate valve, although it could be a stopper rod arrangement.

Figure 2:
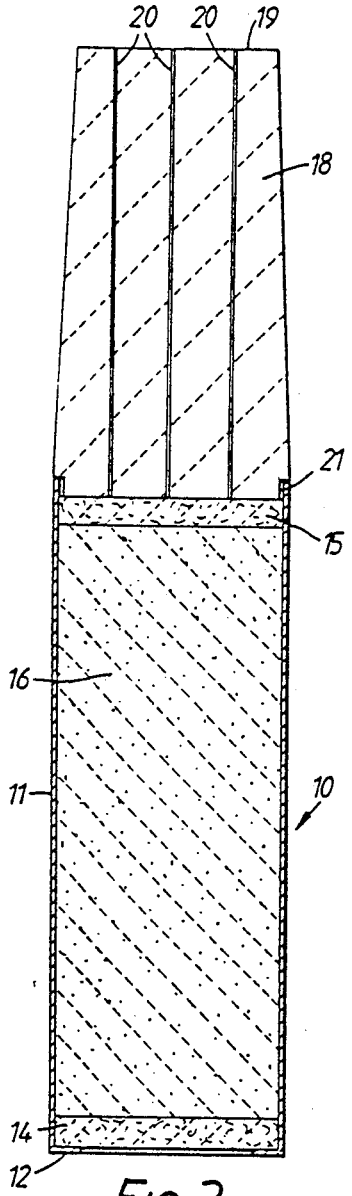
Figure 3:
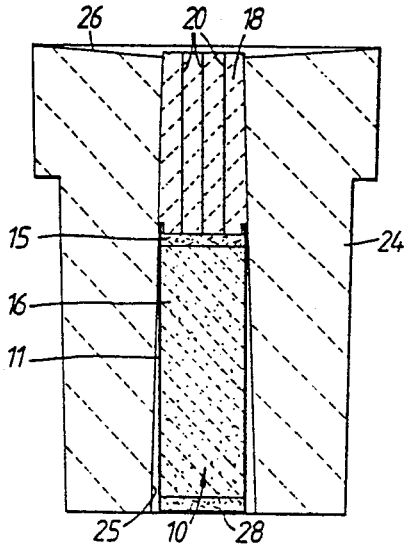
Figure 4:
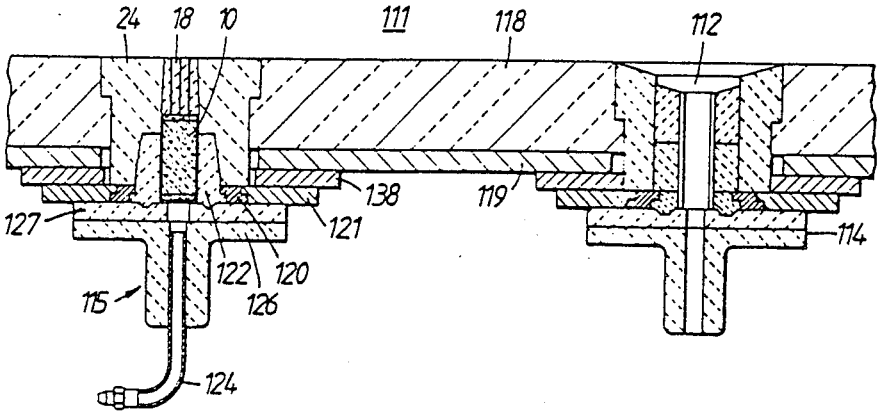
Figure 5:
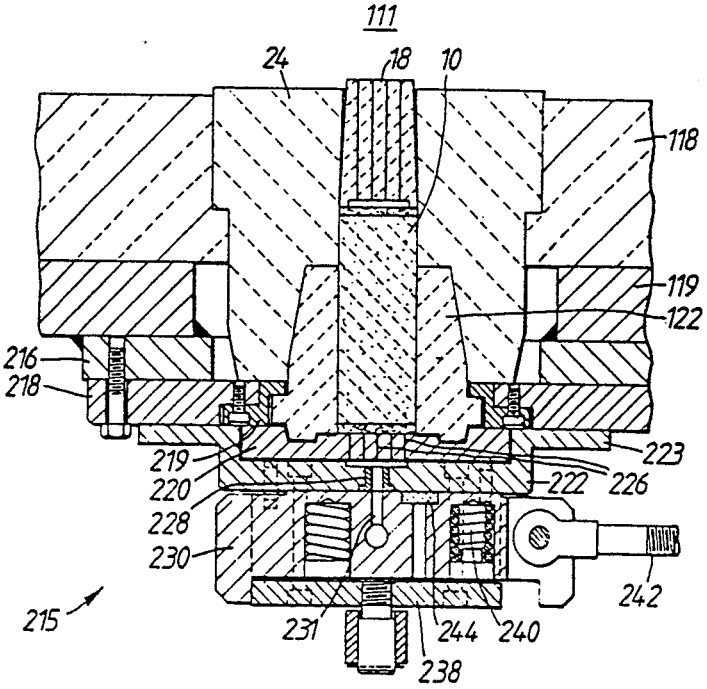
Figure 6:
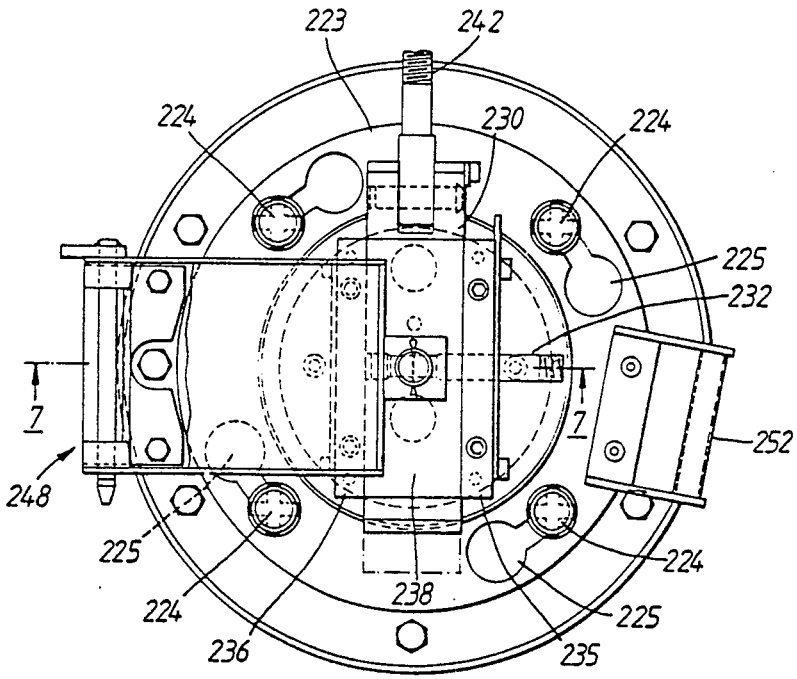
Figure 7:
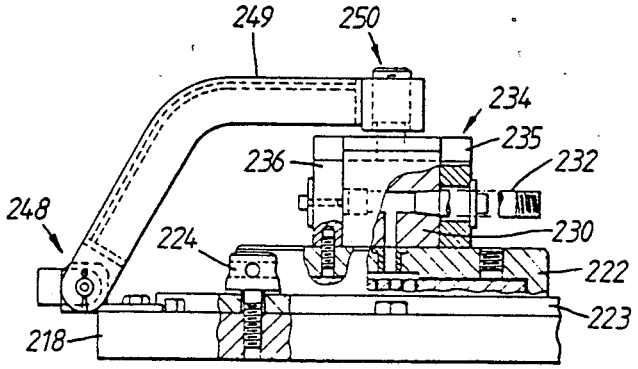
Figure 8:
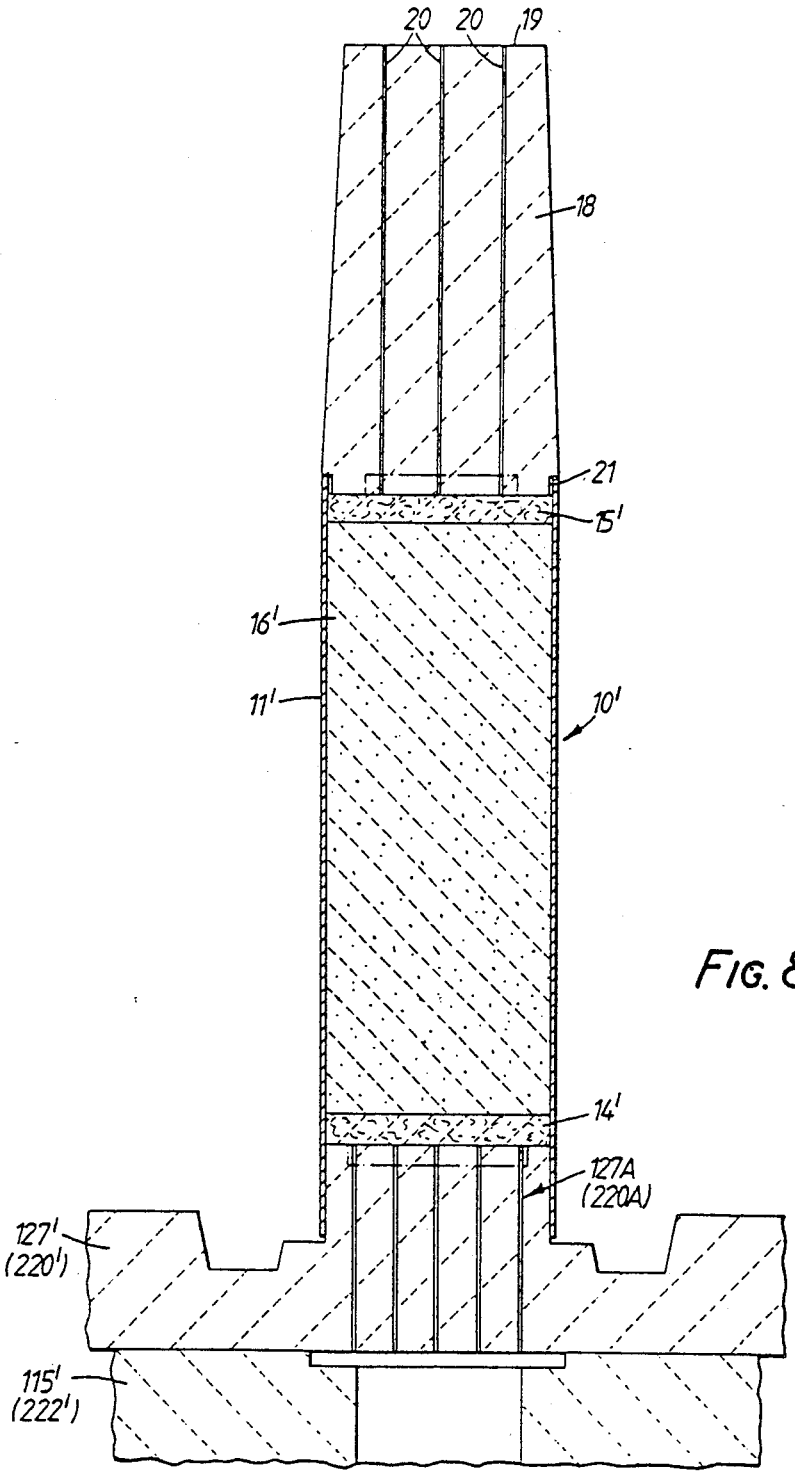

Embodiments of the invention will now be described by way of example with reference to the accompanying drawings, in which:

FIG. 1 is a cross-sectional view through a gas injection cartridge according to the invention, FIG. 2 is a cross-sectional view of a gas injection nozzle according to the invention, FIG. 3 is a cross-sectional view of the cartridge according to the invention in association with a gas-discharge block, FIG. 4 is a cross-sectional view through the bottom of a ladle or tundish funished with gas injection means according to the invention and with a sliding gate valve, FIGS. 5, 6 and 7 show a preferred gas injection device according to the invention, and are respectively a cross-section therethrough, a bottom plan view and a fragmentary, part-sectional view taken on the line 7—7 of FIG. 6, and FIG. 8 is a cross-sectional view of a slightly-modified cartridge according to the invention, and shows its interfitting with associated upstream parts of a gas injection means.

FIG. 1 of the accompanying drawings shows a longitudinal section through a gas injection cartridge according to the invention. The cartridge 10 is an essential element of gas injection arrangements embodying the invention and will need to be replaced periodically. The illustrated cartridge 10 has a cylindrical gas-impermeable sleeve 11, e.g. made of metal, which is open at both its ends. At one end, as shown, the sleeve has an inturned lip 12. The other end of the sleeve might also be inturned in some instances, although such is not the case for this preferred cartridge. Both ends of the cartridge 10 are closed by wads 14, 15 of fibrous refractory material of felt-like nature. The wads 14, 15 are tightly jammed into the respective ends of the sleeve and both are compressible for reasons explained hereinafter. The wads 14, 15 can comprise KAOWOOL (Registered Trade Mark) which is manufactured by Morganite Ceramic Fibres Limited. Retained between the wads 14, 15, the cartridge 10 has a filling 16 of particulate refractory matter. The particulate filling 16 and the wads 14, 15 are gas permeable so that when gas under pressure is fed to one end of the cartridge 10 (e.g. the end with the inturned lip 11), the gas will flow along the cartridge and exit from the other end. The particulate filling 16 can comprise a sand. The actual composition of the filling will be determined according to the injection conditions e.g. the temperatures to which the cartridge 10 is likely to be subjected in service and the chemical reactivity of the gas to be injected. Where the cartridge is to be used in a ferrous environment, its filling can comprise a granular refractory material, for example a blend of a sand and graphitic material. The filling can, therefore, comprise a blend such as is used in the steel industry as a well filler.

While the cartridge 10 is gas permeable, it is designed to be impermeable to liquid, i.e. molten metal.

KAOWOOL (RTM) is not the only commercially available material suitable for the wads 14, 15. Possible alternatives among many others include REFRASIL (RTM) Batt BA-1M manufactured by Chemical and Insulating Company Limited of Darlington U.K. and FIBERFRAX (RTM) which is a mineral wool material marketed by Carborundum Limited in both woven and dense felt forms.

In gas injection apparatus according to the invention, the cartridge 10 may be arranged in tandem with a gas-discharge block of some kind. FIG. 2 shows one such gas-discharge block 18 fitted atop the cartridge 10. The block 18 is a cylinder, in this instance slightly-tapered, made e.g. from a pressed and fired refractory or from a moulded refractory castable. The block 18 can be made from a refractory which is inherently porous or foraminous to allow gas that has passed through the cartridge 10 to enter and traverse the block before exiting from a discharge face 19 thereof into the melt. As shown, however, the block is pierced from end to end by a capillary passage 20 or a plurality thereof to facilitate gas flow through the block. The or each capillary passage 20 may be 1 mm or less in diameter. The size should be sufficient to pass gas freely but insufficient to permit molten metal to traverse the block in significant amounts should gas flow cease.

It will be observed that a rebate 21 encircles the block 18 at its end contacting the cartridge 10. The rebate 21 accepts an end portion of the cartridge sleeve 11 which projects above the fibrous wad 15, thereby enabling the block 18 and cartridge 10 to interfit. Longitudinally, the rebate 21 is longer than the distance by which the sleeve 11 projects above the wad 15.

Like the cartridge 10, the block 18 is an expendable item. Ordinarily, when the vessel is emptied of melt, a skin of frozen metal will form on the discharge face 19, or the metal will enter and freeze in the capillary passages. In either event, subsequent injection through the block 18 will be impaired if not actually prevented, so the block will need replacing at frequent intervals. Of course, if the cartridge and block are used for injecting gases into some other liquids, less frequent replacement of these items may be appropriate.

In use, the cartridge 10 and block 18 are mounted in a gas injection nozzle body installed in a seating in the refractory lining of the vessel. The arrangement of cartridge, block 18 and nozzle body 24 is illustrated in FIG. 3. The nozzle body has a generally cylindrical duct 25 therein to receive the cartridge 10 and block 18. The duct 25 tapers slightly, at least at a downstream end thereof, to match the slightly tapered block 18 and to enable a liquid-tight fit to be formed with the block. The nozzle body can be a pressed and fired refractory or a refractory concrete casting. Its external shape can be varied to suit the seating in the vessel lining and hence need not be as shown.

If desired, the block 18 could be eliminated. The duct 25 would then be blind, terminating internally within the nozzle body 24. The end portion of the nozzle body 24 between the end of the duct and discharge face 26 of the nozzle body 24 would be made gas porous, e.g. by the provision of capillary passages. Generally speaking, such an adaptation is not preferred, particularly where the nozzle body 24 and cartridge 10 are employed for injecting gas into molten metals. The cost of replacing the nozzle body will usually be substantially higher than the cost of replacing the relatively small block 18. However, if the nozzle body were of a different and appreciably more compact design, it might be feasible for it to be made a dispensible item and enabling the separate block 18 to be eliminated.

The nozzle assembly shown in FIG. 3 will be utilised with a gas inlet means for conveying gas from a supply to the upstream end of the cartridge, i.e. end 28 thereof. The inlet means is adapted to urge the cartridge 10 inwardly into sealing contact with the block 18 or the said end portion of the nozzle body. Referring to FIG. 2, the projecting end of the sleeve 11 is forced into the rebate 21 and wad 15 is compressed between the confronting end of the block 18 and the filling 16 inside the cartridge 10. At the same time, this end of the sleeve may be thrust into a liquid-tight and preferably also a gas-tight interference fit within the taper of the nozzle duct 25.

When the cartridge 10 is properly seated against the block 18 or the said end portion, any liquid such as molten metal which might penetrate as far as the cartridge 10 will be blocked by the latter from leaking outwardly from the duct 25.

The inlet means can take various forms which it will be within the capability of the ordinarily skilled designer to devise. One such inlet means is shown in FIG. 4 to which reference is now made.

FIG. 4 illustrates a vessel such as a ladle 110 furnished with gas injecting means according to this invention and with a separate teeming means. The vessel 111 has an opening 112 through which molten metal can be controllably teemed by operation of teeming control means 114. The teeming control means 114 is a sliding gate valve. Beside the valve 114 the vessel 111 has the gas injection means 115.

Sliding gate valves, of which there are several basic types, are commercially available and well known in the art. The structure, mounting and operation of such valves therefore need not be described in detail here.

The teeming control means could instead comprise a stopper rod arrangement which likewise is well known in the art.

The gas injection means 115 is shown in the bottom of vessel 111 but could be placed in a sidewall of the vessel adjacent the bottom and the teeming control means.

The gas injection means 115 comprises a gas passage formed in a refractory gas-admitting nozzle block 24 cemented in a seating therefor in the insulating lining 118 of the vessel 111. The nozzle block 24 protrudes through a metal outer casing 119 of the vessel 111 and is supported in place by a spigot 120 and carrier plate 121. A solid, gas-porous discharge block 18 closes off the passage or duct of the nozzle block, and serves as a distributor into the melt of gas fed under pressure to the nozzle block 24. The passage or duct is, in this instance, provided in part by the nozzle block 24 and in part by a refractory insert ring 122 which is supported centrally of the nozzle block 24 by the spigot 122.

A gas passage leading to the nozzle block 24, cartridge 10 and porous block 18 includes a duct provided by two orificed refractory bodies; the duct communicates with a gas feed pipe 124. Pipe 124 has a connection at one end for a usually flexible gas supply pipe (not shown). The pipe 124 terminates in a lower one of the two orificed bodies 126, 127. The duct formed by the two bodies 126, 127 is a continuation of the nozzle bore, and in this case the duct is co-linear with the bore.

The upper orificed body 127 is fixedly mounted with its orifice in registry with the nozzle passage. The lower body 126 is mounted for to-and-fro lateral movement in contact with the underside of body 127. Moving the lower body 26 thus enables its orifice to be brought into and out of registry with the orifice of the stationary upper body, the orifices being in registry for gas injection. The two bodies 126, 127 will be seen to form a plate valve which must be tight against leakage of molten metal when their orifices are fully out of registry. Biasing means, not shown, force the lower plate 126 firmly against the upper plate in order to obtain leak-tightness. Also, to assure leak-tightness, the insert ring 122 forms a recessed or stepped joint with the upper surface of the upper orificed body 127. Further, the assembly comprising bodies 126, 127 and insert ring 122 must be as gas tight as practical.

The illustrated arrangement has been designed to facilitate the operation of changing the cartridge 10 and discharge block 18. The nozzle block 24 therefore has a downwardly and outwardly divergent duct matching the block 18 at least, as shown, at its uppermost end. Removal of the cartridge 10 and porous block 18 is through the bottom of the vessel 11 after dismounting the bodies 126 and 127.

The nozzle block 24 can be a one-piece member but often more conveniently is an assembly of a plurality of components as shown. The lower end of insert ring component 122 forms a stepped joint with the upper surface of the stationary orificed body 127, and this joint is cemented e.g. with a mastic to guard against escape of the gas from this joint.

Manual, pneumatic or hydraulic means can be provided to displace the lower orificed body 126 laterally relative to the upper body 127.

In normal operation, the orifices in the bodies 126, 127 will be in exact registry. Gas will be admitted to the nozzle block passage, the cartridge 10 and porous block 18 through the duct constituted by the aligned orifices, for distribution into the melt after traversing the porous block. Gas admission will normally take place prior to teeming but in some pouring operations can be simultaneous with teeming through the valve 14.

If it is suspected that either the cartridge 10 or the porous block 18 (or a cement seal between it and the nozzle block 24—if any) has become defective, occasioning a risk of leakage, lower orificed body 126 will be displaced laterally e.g. to the right as viewed in FIG. 1. This is to place the orifices of bodies 126, 127 out of registry, to interpose an imperforate portion of body 126 across the gas passage, and thereby ensure no molten metal can leak from the gas injection means 115.

Periodic inspection of the cartridge 10 can be performed whenever the vessel 111 is empty. After removing the orificed bodies 126, 127 e.g. by swinging them downwardly away from a mounting plate 138 secured to the vessel casing 119, the insert ring can be extracted followed by the cartridge 10.

For maximum safety in use, the lower orificed body 126 will be moved to close the duct when gas injection is finished.

It will be appreciated that it is important to avoid gas leakages. Provided the cartridge 10 is firmly pressed against the porous discharge block 18, leakage of gas downwardly outside the cartridge 10 will be substantially prevented. Gas could leak from the cement or mastic joint between the insert ring 122 and the stationary upper plate, or along the interface between the two plates. Springs, not shown, bias the plates 126, 127 upwardly against the insert ring 122, and in ideal circumstances can assure adequate gas tightness between these parts. However, manufacturing tolerances can work against the achievement of gas tightness. The construction of the cartridge 10, in particular its compressible wads 14, 15, and its telescoping interfitting with the discharge block 18 significantly contribute to the attainment of gas tightness. The arrangement provides enough give for the refractory parts to adjust one to another for the springs to press them leak tightly together.

In a modification, not shown, the lower nozzle insert ring component 122 is integral with the orificed upper body 127. Desirably the resulting integral body is encased in a metal jacket apart from its plane lower surface (which the lower body 126 contacts) and its uppermost surface. Advantageously, the lower body 126 is identical in shape to such an integral body and has the same size bore, so that the bodies are interchangeable. Obviously this simplifies manufacture and minimises cost as well as rationalises the user's stock requirements. In such a modification, the design should be such that the cartridge is adequately compressed longitudinally when the springs, not shown, are holding the orificed bodies 126, 127 to their proper operating positions.

In the modification, the porous discharge block 18 is once more mounted in the nozzle block 24 and is replaced when defective by pushing it out of the block 24 in a downward direction, after first dismounting the components below the discharge block 18.

The discharge block 18 can be made of porous or foraminous refractory, i.e. one possessing numerous tiny passages meandering randomly through it. As shown, however, the block 18 is made from gasimpermeable refractory material, rendered foraminous and gas-conducting by being pierced by one or more narrow, capillary-type passageways 20.

The passageway(s) 20 can be formed by small bore tubing of refractory material such as alumina. Such tubing is embedded in the body of the block 18 as the latter is pressed or cast. The bore size can, for example, be 1 mm or less in diameter. Alternatively, the passageways can be formed by pressing or casting the refractory mass to form the block 18 around filaments of 1 mm diameter or less e.g. of nylon or some other material which burns away when the pressing or casting is subjected to an elevated temperature, for instance during firing. The resulting bore size can again be 1 mm or less, e.g. 0.6 mm, or even larger than 1 mm provided metal can be prevented from flowing through the passageway(s). Still further, the block 18 can be formed by pressing or casting around a plurality of wires of 1 mm diameter or less, said wires being subsequently pulled from the formed block thereby creating the passageways.

In use of the apparatus according to the invention, metal may freeze in or on the block 18. Oxygen lancing may then enable the block 18 capable of passing gas. Such lancing may permit the block 18 to be reused after the vessel has been emptied, if the block is otherwise in a good and safe condition.

In use of the preferred arrangement consisting of the cartridge and a nozzle discharge end portion or nozzle plug pierced by capillary passages, the cartridge beneficially provides an even flow of gas to the contiguous face of the end portion or plug, while the passages therein ensure the gas enters the liquid as fine, well directed and directionally stable jets.

Desirably, an end portion or plug having capillary passages has a central recess in its face contiguous with the cartridge. The capillary passages open to the recess which serves as a small plenum and ensures there is a ready supply of gas to the passages. Such a plug is shown in FIG. 5; it is cemented into the discharge end of the nozzle passage.

Whilst FIG. 4 shows a practical gas injection means 115 in simplified form, a preferred gas injection device is shown in FIGS. 5 to 7. Features of the preferred device 215 will now be described.

The nozzle body 24, plug 18 and cartridge 10 are assembled and located as before in the vessel lining 118. The means to convey gas to cartridge 10 in the passage of the nozzle body 24, and to shut off this passage, are mounted on the exterior of the vessel 111. An adaptor plate 216 is e.g. welded to the metal shell 119 of the vessel and an apertured mounting plate 218 is bolted thereto. An insert collar 219 is bolted in the aperture of the mounting plate and serves to centre the refractory insert ring 122. A stationary refractory plate 220 is held in contact with the insert ring 122 by a metal retaining plate 222. As before, the refractory plate 220 and insert ring 122 form a stepped joint which is sealed by a suitable sealant. The retaining plate 222 is circular in plan, and in section resembles a shallow cup having an onwardly-projecting rim or flange 223. The refractory plate 220 is seated and suitably sealed in the hollow of the retaining plate 222. The rim 223 of the latter is clamped in facial contact with the underside of the mounting plate 218 by a set of bolts 224 passing through key-hole openings 225 in the rim 223. Thus clamped, the retaining plate 222 holds the refractory plate sealed with the insert ring 122.

The refractory plate 220 has a plurality of passages 226 across its thickness, located centrally, for passing gas to the upstream end of the cartridge 10 in contact therewith.

The retaining plate 222 has a recess in the upper surface of its hollow, the recess being located beneath the passages 226 in the refractory plate. Also, a bore extends through the retaining plate to the recess, which serves as a plenum for the passages 226 when gas is passed through the said bore to the recess. The bore has a lining or insert 228 made of thermally conductive material such as carbon or copper. The underside of the retaining plate is machined smooth and flat.

Assembled to the underside of the retaining plate 222 is a slide frame and a metal slide block. The slide block 230 has a passage 231 which normally registers with the bore insert 228 thereabove. The passage 231 leads to an inlet fitting 232 for a gas supply line (not shown). The slide block 230 is shown in its normal operating position in FIG. 5. In this position, it will be recognised that gas supplied to inlet fitting 232 will flow into and up passage 231, up bore insert 228, through refractory plate 220 and thence to the cartridge 10 and plug 18 for entry to the vessel's contents.

The slide frame 234 comprises a pair of spaced-apart parallel side plates 235, 236 and a bottom plate 238. The side plates 235, 236 are fastened to the underside of the retaining plate 222 and depend from it. The bottom plate 238 is bolted to the side plates. The frame 234 snugly but slidably receives the slide block 230. This has its topside machined smooth and flat to coact with the similarly-finished underside of the retaining plate. There are springs 240 acting between the slide block 230 and the frame bottom plate 238 to urge the block into gas-tight facial contact with the retaining plate 222.

A push rod 242 is secured to the slide block 230, the push rod leading to a manual actuator, a hydraulic actuator or the like, not shown. The push rod 242 is for displacing the block 230 (to the left as viewed in FIG. 5) suddenly to shut off the gas supply and e.g. to close the equipment against leakage of melt in the very unlikely event of failure of the plug 18 and cartridge 10. When the block 230 is thus displaced, a thermally conductive disc 244 seated in its topside is placed across the bore insert 228. The disc may be made of carbon or copper. Should molten matter e.g. metal leak out of the vessel, by-passing the plug 18 and cartridge 10, then it will be arrested by the disc 244. The thermally conductive nature of the disc and bore insert 228 should sufficiently chill the leakage to cause it to freeze safely, and thereby prevent molten matter escaping completely from the equipment.

The retaining plate 222 as well as the slide frame 234 and slide block 231 secured thereto are fastened to the mounting plate 218 by bolts 224, and when the device 215 is assembled, the cartridge 10 is compressed longitudinally in this instance. The refractory plate 220 is held firmly and gas tightly against the insert ring 122. Further, bolts 224 are tightened sufficiently to force the rim 223 of plate 222 gas tightly against the mounting plate 218. If desired sealing means such as a fibre seal (not shown) may be located in the interface between the rim 223 and the mounting plate 218.

When it is necessary to service the gas injection means, e.g. to replace the plug 18 and/or the cartridge 10, the bolts 224 will be slackened sufficiently for the retaining plate 222 to be rotated through a small angle placing the enlarged ends of the key-hole openings 225 opposite the heads of the bolts 224. The retaining plate including components affixed to or supported thereby can then be detached, thus giving access to the nozzle passage. The slide frame 234 and slide block 230 can be disassembled as necessary for servicing, and the refractory plate 220 can be replaced if required.

The weight and bulk of the retaining plate 222 and the components carried thereby can be considerable. To avoid the risk of this assembly being dropped inadvertently when it is rotated for release, the retaining plate 222 is desirably linked to the mounting plate 218 by a hinge means 248 secured to the latter. An arm 249 extends from the hinge 248 towards the underside of the frame bottom plate 238 and a swivel connection is formed between this plate and the arm by a spigot and socket 250 or another attachment. Further, a handle 252 is attached to the retaining plate 222. Thus, after slackening the bolts 224, the plate 222 is rotated by means of the handle 252 and, once the bolt heads align with the enlarged ends of the key-hole openings 225, the plate 222 is swung downwards on the arm 249 about the hinge 248. The latter for convenience has a dismountable pivot pin to permit the retaining plate 222 to be removed completely from the mounting plate 218.

Reassembly of this gas injection device will in essence be the reverse of its disassembly and will be apparent from the foregoing description.

The cartridge 10 of FIGS. 1 to 5 can beneficially be modified, as can the upper orificed body 127 of FIG. 4 and the refractory plate 220 of FIG. 5, all in the interests of attaining a good, gas tight seal at the upstream end of the cartridge, to render minimal or eliminate loss of gas through leakage. Possible modifications are shown in FIG. 8. Cartridge 10' again comprises a sleeve 11' e.g. of metal filled with particulate refractory material 16', which is held in place by wads 14', 15' of compressible, fibrous refractory material located in the end regions of the cartridge. In this modification, both the lower and upper wads 14', 15' are inset a short distance from the corresponding extreme ends of the sleeve 11'. Moreover, the sleeve 11' has no inturned lip at its lower end. As explained hereinbefore, the upper wad 15' is inset to ensure a gas-tight sealing between the cartridge 10' and end-closing means or block 18. The lower wad 14' is inset for a like purpose, for creating a seal with the orificed body 127' or refractory plate 220'. The latter body or plate is furnished with an upstanding protrusion 127A, 220A on its upper surface sized to fit closely into the bottom or upstream end of the sleeve 11', to press against the lower wad 14'. The distance by which the lower wad 14' is inset, and the height of the protrusion 127A, 220A are such as to ensure that when the injection apparatus is properly set up for injection, both wads 14', 15' are duly compressed to form effective seals at the ends of the cartridge 10'. Thus, gas can be fed into and from the cartridge without fear of significant leakage of gas.

As shown, body 127' or plate 220' is pierced by small bores, but it could have a single, larger bore such as shown in body 127 of FIG. 4. If desired, the end closing means or plug 18 and/or the body 127' or plate 220' can be recessed as shown by chaindotted lines, to provide a plenum therein.

Industrial Applicability

The injection cartridge and apparatus with which the cartridge is used are applicable to the introduction of gases into molten metals contained in vessels such as ladles. The molten metals can be ferrous or non-ferrous, and gases can be introduced to achieve thermal and/or compositional uniformity of the melt before it is poured from the ladle, or to change its chemical composition.

We claim:

1. An injection cartridge, for use in injecting gas through the wall of a vessel into a high temperature liquid contained therein, the cartridge comprising an open-ended gasimpermeable sleeve blocked adjacent each of its opposite ends closed by a compressible wad of fibrous refractory material, and containing a filling of particulate refractory matter, the cartridge being permeable to gas flow from one end to the other and impermeable to liquid flow therethrough.

2. A cartridge according to claim 1, wherein the sleeve is a metal tube.

3. A cartridge according to claim 1, wherein the particulate filling is selected from materials including sand, and a mixture of sand and graphitic material.

4. A gas injection apparatus comprising a cartridge according to claim 1 and a refractory gas-discharge block arranged in tandem therewith, the discharge block having one end interfitting with one end of the cartridge and being porous or foraminous to allow gas but not liquid to traverse the block.

5. Apparatus according to claim 4, wherein the discharge block is pierced by a plurality of capillary passages for conveying gas through the block.

6. Apparatus according to claim 4, wherein the filling is selected from materials including sand, and a mixture of sand and graphitic material.

7. A gas injection nozzle, for installation in the wall of a vessel and for use in injecting gas into a high temperature liquid, comprising a refractory nozzle body having a passage therein and a gas porous or foraminous end portion closing the passage at a discharge end of the body, and closely fitted in the passage is a porous gas injection cartridge comprising an open-ended, gas-impermeable sleeve having upstream and downstream ends, closed adjacent each end by a compressible wad of fibrous refractory material and containing a filling of particulate refractory matter, the cartridge being permeable to gas flow from the upstream to the downstream end and impermeable to liquid flow therethrough.

8. A nozzle according to claim 7, wherein the said end portion is rendered gas permeable by capillary passages extending therethrough.

9. A nozzle according to claim 7, wherein the sleeve of the cartridge is a metal tube.

10. A nozzle according to claim 7, wherein the particulate filling of the cartridge is selected from materials including sand, and a mixture of sand and graphitic material.

11. A nozzle according to claim 7, wherein the end portion is configured to interfit with the downstream end of the cartridge.

12. A nozzle according to claim 7, wherein the cartridge is an replaceable item.

13. Gas injection apparatus comprising a nozzle according to claim 7 and gas inlet means for conveying gas from a supply to the upstream end of the cartridge, the inlet means being positioned to urge the cartridge into sealing contact with the said end portion, whereby in use any liquid which may permeate through the end portion is blocked from escaping via the passage by the liquid-impermeable cartridge.

14. A nozzle according to claim 7, wherein the passage extends wholly through the body and the said end portion is a plug element fitted liquid-tightly into a discharge end of the passage.

15. A nozzle according to claim 14, wherein the plug element is an replaceable item of the nozzle.

16. A nozzle according to claim 14, wherein the said end portion is rendered gas permeable by capillary passages extending therethrough.

17. Metal pouring apparatus comprising a container vessel for molten metal, an opening in or adjacent the bottom of the vessel and associated means operable to control teeming of molten metal through the opening, and means for injecting gas into molten metal in the vessel, the injecting means including a nozzle installed in a wall of the vessel in the vicinity of and separate from the said opening and the teeming control means, and ducting exteriorly of the vessel for conveying gas to a passage through the nozzle, the ducting including two abutting orificed refractory bodies, one of the refractory bodies being movable relative to the other to place the orifices out of registry thereby to close the ducting and prevent any molten metal entering the nozzle passage from escaping from the vessel via the nozzle and ducting, and inside the passage there is melt-tightly fitted an injection cartridge comprising an open-ended, gas-impermeable sleeve closed adjacent each of its opposite ends by a compressible wad of fibrous refractory material and containing a filling of particulate refractory matter, the cartridge being permeable to flow of gas towards the vessel interior and impermeable to flow of molten metal therethrough.

18. Apparatus according to claim 17, wherein the particulate filling is selected from materials including sand, and a mixture of sand and graphitic material.

19. Apparatus according to claim 17, wherein the nozzle has a porous or foraminous closing means at a gas discharge end thereof, and the cartridge is compressed between the closing means and the said bodies.

20. Apparatus according to claim 19, wherein the closing means is a solid plug fitted in a discharge end of the nozzle, the plug being formed from substantially gas-impermeable refractory material and being pierced by at least one capillary passageway for passing gas into the vessel.

21. Apparatus according to claim 19, wherein the foraminous closing means is an integral part of the nozzle and is pierced by a capillary passageway or a plurality thereof, for passing gas into the vessel.

22. Gas injection apparatus for introducing gas into a container vessel for molten metal via an opening in or adjacent the bottom of the vessel, comprising a nozzle for installation in the said opening of the vessel, the nozzle having a passage with a gas permeable closing means through which gas in use is passed to the melt, there being melt-tightly and gas-tightly fitted inside the passage an injection cartridge comprising an open-ended, gas-impermeable sleeve blocked adjacent each of its opposite ends by a compressible wad of fibrous refractory material and containing a filling of particulate refractory matter, the cartridge being permeable to flow of gas towards the vessel interior and impermeable to flow of molten metal therethrough, and ducting in operative, gas-tight juxtaposition with the nozzle passage and its cartridge for conveying gas thereto from a supply, the ducting including a stationary body, a movable body and means to bias the latter into gas-tight, slidable contact with the former, the bodies having orifices therein which, in a first position of the movable body are registered for passing gas to the nozzle, and in a second position thereof are out of registry for closing the ducting, the stationary body having an insert sleeve defining its orifice and the movable body having an imperforate insert positioned therein to register with the insert sleeve when the movable body is moved to the duct-closing position, the two inserts being made of highly thermally conductive materials.

23. Apparatus according to claim 22, wherein the stationary body has a refractory plate element mounted thereto, the plate element being perforated to convey gas from the orifice of the stationary body to the nozzle passage, and there being sealing means between the plate element and nozzle and between said element and said stationary body.

24. Apparatus according to claim 22, wherein the particulate filling is selected from materials including sand, and a mixture of sand and graphitic material.

25. Apparatus according to claim 22, wherein the stationary body has a refractory plate element mounted thereto, the plate element being perforated to convey gas from the orifice of the stationary body to the nozzle passage, and there being sealing means between the plate element and nozzle and between said element and the stationary body.

26. Apparatus according to claim 22, wherein the nozzle has a porous or foraminous closing means at a gas discharge end thereof, and the cartridge is compressed between the closing means and the said bodies.

27. Apparatus according to claim 26, wherein the closing means is a solid plug fitted in a discharge end of the nozzle, the plug being formed from substantially gas-impermeable refractory material and being pierced by at least one capillary passageway for passing gas into the vessel.

28. Apparatus according to claim 26, wherein the foraminous closing means is an integral part of the nozzle and is pierced by a capillary passageway, or a plurality thereof, for passing gas into the vessel.

29. A method employing a gas injection apparatus for introducing gas into a container vessel for molten metal via an opening in or adjacent the bottom of the vessel, said apparatus comprising a nozzle for installation in the said opening of the vessel, the nozzle having a passage with a gas permeable closing means through which gas in use is passed to the melt, there being melt-tightly and gas-tightly fitted inside the passage an injection cartridge comprising an open-ended, gas-impermeable sleeve blocked adjacent each of its opposite ends by a compressible wad of fibrous refractory material and containing a filling of particulate refractory matter, the cartridge being permeable to flow of gas towards the vessel interior and impermeable to flow of molten metal therethrough, and ducting in operative, gas-tight juxtaposition with the nozzle passage and its cartridge for conveying gas thereto from a supply, the ducting including a stationary body, a movable body and means to bias the latter into gas-tight, slidable contact with the former, the bodies having orifices therein which, in a first position of the movable body are registered for passing gas to the nozzle, and in a second position thereof are out of registry for closing the ducting, the stationary body having an insert sleeve defining its orifice and the movable body having an imperforate insert positioned therein to register with the insert sleeve when the movable body is moved to the duct-closing position, the two inserts being made of highly thermally conductive materials, said method comprising injecting said gas into the molten metal in the vessel while simultaneously teeming metal from the vessel via a teeming control means of the vessel.

30. The apparatus of claim 29 wherein said stationary body and said movable body each comprise metal.

31. A method employing a metal pouring apparatus, said apparatus comprising a container vessel for molten metal, an opening in or adjacent the bottom of the vessel and associated means operable to control teeming of molten metal through the opening, and means for injecting gas into molten metal in the vessel, the injecting means including a nozzle installed in a wall of the vessel in the vicinity of and separate from the said opening and the teeming control means, and ducting exteriorly of the vessel for conveying gas to a passage through the nozzle, the ducting including two abutting orificed refractory bodies, one of the refractory bodies being movable relative to the other to place the orifices out of registry thereby to close the ducting and prevent any molten metal entering the nozzle passage from escaping from the vessel via the nozzle and ducting, and inside the passage there is melt-tightly fitted an injection cartridge comprising an open-ended, gas-impermeable sleeve closed adjacent each of its opposite ends by a compressible wad of fibrous refractory material and containing a filling of particulate refractory matter, the cartridge being permeable to flow of gas towards the vessel interior and impermeable to flow of molten metal therethrough, said method comprising injecting said gas into molten metal in the vessel while simultaneously teeming metal from the vessel via the teeming control means.

* * * * *